United States Patent [19]

Maness

[11] 4,111,831

[45] Sep. 5, 1978

[54] INHIBITING CORROSION OF STAINLESS STEEL BY RUTHENIUM-CONTAINING NITRIC ACID SOLUTION

[75] Inventor: Roy F. Maness, Richland, Wash.

[73] Assignee: Exxon Nuclear Company, Inc., Bellevue, Wash.

[21] Appl. No.: 692,590

[22] Filed: Jun. 3, 1976

[51] Int. Cl.[2] ..... C09K 3/00

[52] U.S. Cl. ..... 422/12; 252/389 R; 252/387; 252/396

[58] Field of Search ..... 252/396, 389 R, 387; 21/2.5 R

[56] References Cited

U.S. PATENT DOCUMENTS

| | | | |
|---|---|---|---|
| 2,994,190 | 8/1961 | Burton | 252/387 |
| 3,174,818 | 3/1965 | Rust | 21/2.5 |

*Primary Examiner*—Benjamin R. Padgett
*Assistant Examiner*—Josephine Lloyd
*Attorney, Agent, or Firm*—Jack Matalon

[57] ABSTRACT

The initial step for conventionally reprocessing spent nuclear fuel is to treat the nuclear fuel rods with concentrated nitric acid at elevated temperatures to dissolve out the contents of the fuel rods. The resultant solution contains ruthenium values present in an oxidation state of at least +4 and the presence of such ruthenium values causes intolerably high corrosion of stainless steel equipment which may come in contact with the hot concentrated nitric acid solution. The corrosion of stainless steel from such ruthenium-containing nitric acid solutions may be inhibited by treating the solutions with a reducing agent comprising nitrogen oxide. It is especially convenient to generate the reducing agent in situ by adding a sugar (e.g. sucrose) to the nitric acid solution so as to reduce substantially all of the dissolved ruthenium values having an oxidation state of at least +4 to an oxidation state of less than +4.

15 Claims, No Drawings

INHIBITING CORROSION OF STAINLESS STEEL BY RUTHENIUM-CONTAINING NITRIC ACID SOLUTION

The present invention relates to a novel method of reducing (or inhibiting) the corrosion of stainless steel by nitric acid solutions at elevated temperatures and containing dissolved ruthenium values. More particularly, it relates to the reduction or inhibition of corrosion of stainless steel equipment (e.g. storage tanks, piping, evaporators, condensers, etc.) by such ruthenium-containing nitric acid solutions that result from the dissolution of spent nuclear reactor fuels, especially those spent nuclear reactor fuels that have received a relatively high rate of irradiation (e.g. 20,000 to 40,000 MWD/tonne at a rate of 20 to 40 MW/tonne).

Stainless steel is widely used for equipment to handle nitric acid solutions because it is the cheapest material available having adequate corrosion resistance under ordinary conditions (the corrosion of stainless steel in 10 M nitric acid at room temperature is less than 0.1 mil per year). However, there are conditions under which corrosion rates are appreciable and repair or replacement of equipment becomes costly. Corrosion rates increase with temperature, particularly at or near the atmospheric boiling point of the solution. The rates also increase with acid concentration and the concentration of iron and chromium in solution.

It is well known that corrosion of stainless steels by nitric acid solutions is catalyzed by chromium in the +6 oxidation state, e.g. see U.S. Pat. No. 3,174,818. The catalytic action of chromium in the +6 state becomes especially severe when the nitric acid solution is at an elevated temperature. Under such conditions, as chromium in the +6 oxidation state builds up, the nitric acid solution will progressively corrode the stainless steel vessel thereby affording a buildup of chromium and iron as corrosion products. As this occurs, the corrosion becomes especially severe due to the autocatalytic effect of the buildup of the catalysts — chromium and iron — in the solution.

It has been unexpectedly found that even where physical and/or chemical means are employed to inhibit the corrosion of stainless steels as a result of chromium in the +6 state and/or iron being present in the nitric acid dissolver solution, intolerable levels of corrosion of the stainless steel nevertheless occur. It has been unexpectedly found that such intolerable levels of corrosion of stainless steels occurs as a result of the presence of extremely small amounts (e.g. above 0.002 M) concentrations or ruthenium present in an oxidation state of at least +4. Ruthenium is known to exist in oxidation states of 0, +1, +2, +3, +4, +5, +6, +7 and +8; in solution (e.g. as the nitrate), ruthenium commonly exists in the +3, +4, +6 and +8 oxidation states. Accordingly, it is an object of this invention to provide a process whereby concentrations of ruthenium in an oxidation state of at least +4 (ruthenium is formed as a by-product during irradiation of the nuclear fuel and is oxidized to an oxidation state of at least +4 in hot nitric acid) which give rise to intolerable levels of corrosion of stainless steel may be reduced to a tolerable level, i.e. by causing ruthenium present in oxidation states of at least +4 to be reduced to ruthenium in oxidation states of less than +4 such that after such reduction, the ruthenium remaining in the dissolver solution in oxidation states of at least +4 has a concentration of less than about 0.005 M, preferably less than 0.002 M.

In its broadest sense, the present invention involves inhibiting the corrosive effect of a nitric acid solution towards stainless steel, said solution containing dissolved ruthenium values present in an oxidation state of at least +4 by treating the solution with a reducing agent comprising nitrogen dioxide in an amount sufficient to reduce substantially all of the dissolved ruthenium values having an oxidation state of at least +4 to an oxidation state of less than +4, i.e. the reduction reaction should proceed under conditions such that less than about 0.005 M, preferably less than 0.002 M, of ruthenium in the oxidation state of at least +4 remains in the nitric acid solution after the reduction reaction has taken place.

The treatment of the nitric acid solution (typically of a concentration of about 2–10 molar, preferably 3–6 molar) may be readily accomplished by bubbling or sparging the concentrated nitric acid solution with the gaseous reducing agent for a period of time sufficient to reduce substantially all of the ruthenium present in the solution at an oxidation of at least +4 to a lower oxidation state. The amount of gaseous reducing agent and the time required for treatment of the solution with the gaseous reducing agent will, of course, depend on factors such as the concentration of the nitric acid, the volume of the nitric acid solution, the temperature of the nitric acid solution and the lower concentration of ruthenium dissolved therein and present in an oxidation state of at least +4. However, in a typical situation in which the concentration of the nitric acid dissolver solution is in the range of above 4 molar, at a temperature in the range of about 90° C., about 1 mole, preferably 2 or more moles, per mole of $Ru^{+4}$, of nitrogen dioxide bubbled or sparged into such solution will be generally sufficient to reduce substantially all of the ruthenium present in an oxidation state of at least +4 to a lower oxidation state, i.e. such that the concentration of ruthenium present in an oxidation state of at least +4 remaining in the solution after such treatment with nitrogen dioxide will be in the range of less than about 0.005 molar.

Conveniently, it has been found that it is possible to generate the nitrogen oxide, nitrogen dioxide and mixtures thereof in situ by adding to the nitric acid solution a sugar in an amount sufficient to reduce substantially all of the dissolved ruthenium values having an oxidation state of at least +4 to a lower oxidation state.

By the term "sugar" as used herein, is meant a mono- or di- saccharide or a mixture containing such mono- or di- saccharide. Examples of suitable "sugars" include fructose, glucose, arabinose, lactose, sucrose (which is particularly preferred herein), maltose, lactose and cellobiose. Mixtures containing such mono- and/or disaccharides such as molasses and/or corn syrup may also be used, especially for reasons of economy. The amount of sugar necessary to reduce substantially all of the ruthenium present in an oxidation state of at least +4 to a lower oxidation state will, of course, depend on the initial concentration of the ruthenium present in the oxidation state of at least +4 and will also depend on the form of the sugar employed. That is, a disaccharide such as sucrose may be utilized in one half the molar amount which would otherwise be required for the same concentration of ruthenium present in an oxidation state of at least +4 where a monosaccharide is utilized. For this reason, and in view of the relatively small amounts of sugar which are required to generate the gaseous reducing agent in situ, sucrose is the preferred sugar for use in this invention. Based on the disaccharide content of the sugar employed in this invention, about 0.05 mole, preferably at least 0.1 mole of the disaccharide should be added to the nitric acid solution per mole of dissolved ruthenium values having an oxidation state of +4 (one mole of sucrose would react with 4 M $HNO_3$ to yield about 20 moles of nitrogen dioxide). If the dissolved ruthenium values present in the nitric acid solution have oxidation states of greater than +4, proportionately higher amounts of the disaccharide should be utilized in order to generate sufficient nitrogen dioxide in situ in order to reduce ruthenium at oxidation states of higher than +4 to ruthenium having an oxidation state of +3 or lower.

The present invention is applicable to austenitic, ferritic and martensitic stainless steels and it is particularly useful for the austenitic type of stainless steel which is the type conventionally utilized for processing spent irradiated nuclear fuels. The examples set forth below further illustrate the quantitative aspects and procedures of the present invention. In these examples, 304L stainless steel coupons were utilized. Simulated solutions of concentrated nitric acid were prepared with various types of compounds dissolved therein (these compounds would correspond to those which are likely to be found in irradiated, spent nuclear fuels). Ruthenium was added to the dissolver solution in the form of $Ru(NO_3)_3$, i.e. the ruthenium had an oxidation state of +3; of course, upon contact with concentrated nitric acid especially at the elevated temperatures employed in the examples which correspond to those commonly used for processing irradiated, spent nuclear fuels, the ruthenium is oxidized to a higher oxidation state and thus the ruthenium present in the dissolver solution at the elevated temperature indicated had an oxidation state of at least +4. The "waste" solution indicated in the examples set forth below represents the particular dissolver solution which has been concentrated in volume about ten-fold in a tube and shell concentrator operating at the boiling point and at atmospheric pressure.

EXAMPLE 1

Dissolver solutions were prepared to simulate the constituents found in irradiated, spent nuclear fuels (nuclear fuels receiving a total irradiation of approximately 40,000 MWd/tonne at a rate of 40 MW/tonne). The simulated dissolver solution was then concentrated (to approximately 1/10 of its original volume) and most of the uranium values originally present were removed, thereby resulting in a simulated waste solution. The nature of the constituent as well as the molarity of each constituent in the simulated dissolver solution and in the simulated water solution is set forth in Table I below.

TABLE I

COMPOSITION OF SIMULATED DISSOLVER AND WATER SOLUTIONS

| Constituent | Molarity of Simulated Dissolver Solution | Molarity of Simulated Waste Solution |
|---|---|---|
| $HNO_3$ | 2.0 – 4.0 | 4.0 – 8.0 |
| $Fe(NO_3)_3$ | 0.0058 | 0.075 |
| $Cr(NO_3)_3$ | 0.0014 | 0.017 |
| $Ni(NO_3)_2$ | 0.0059 | 0.0044 |
| $NaNO_3$ | 0.0001 | 0.026 |
| $KNO_3$ | 0.0016 | 0.013 |
| $UO_2(NO_3)_2$ | 1.28 | 0.053 |
| $Sr(NO_3)_2$ | 0.0042 | 0.032 |

TABLE I-continued

COMPOSITION OF SIMULATED DISSOLVER AND WATER SOLUTIONS

| Constituent | Molarity of Simulated Dissolver Solution | Molarity of Simulated Waste Solution |
|---|---|---|
| $Ce(NO_3)_3$ | 0.0000 | 0.016 |
| $ZrO(NO_3)_2$ | 0.0165 | 0.125 |
| $MoO_3$ | 0.0186 | 0.116 |
| $Mn(NO_3)_2$ | 0.0000 | 0.28 |
| $Ru(NO_3)_3$* | 0.0094 | 0.071 |
| $Co(NO_3)_2$ | 0.0015 | 0.018 |
| $AgNO_3$ | 0.0002 | 0.003 |
| $Na_2TeO_4$ | 0.0000 | 0.012 |
| $CsNO_3$ | 0.0090 | 0.069 |
| $Ba(NO_3)_2$ | 0.0047 | 0.030 |
| $La(NO_3)_3$ | 0.0000 | 0.028 |
| Rare Earth trinitrates | 0.0316 | 0.205 |

*Although ruthenium was initially added in a valence state of +3 (as the trinitrate), it is rapidly oxidized in nitric acid to a valence state of higher than +3.

EXAMPLE 2

Stainless steel coupons (grade 304L) having a dimension of ½ inch × 1½ inch × ⅛ inch thick were placed in four simulated dissolver solutions at temperatures of 95° C.–100° C. for 1 week. The simulated dissolver solutions were those shown in Table I above except that in the first solution no ruthenium nitrate was added, in the second solution, the molarity of the ruthenium nitrate was ¼ of that shown in Table I, in the third solution, the molarity of the ruthenium was ½ of that shown in Table I and in the fourth solution, the ruthenium molarity was that shown in Table I. These 1-week exposures were repeated six times for each sample (the volume of simulated dissolver solution used in each test was approximately 250 ml. in a glass container). The corrosion rates of the 304L stainless sleel coupons were then averaged over the span of the six 1-week exposures. The average corrosion rates for these tests were 1.0, 1.2, 3.2 and 5.7 mils/month for the first, second, third and fourth solutions respectively.

EXAMPLE 3

Stainless steel coupons (same dimensions and grade as that set forth in Example 2) were exposed to 500 ml of simulated dissolver solutions held at 95°–100° C. for 200–1000 hours. Sucrose was added to the solutions in increments of 3.5 grams per day. The acidity of the solutions was maintained at 4 molar by addition of 16 molar nitric acid. Similar tests were made with 4M $HNO_3$ - 0.01M $Ru(NO_3)_3$ solutions at 95°–100° C. except that a single 3.5 g. sucrose addition was made at the beginning of a 200 hr. exposure period and no addition was made to a second aliquot. The results of these tests are set forth in Table II.

TABLE II

CORROSION OF STAINLESS STEEL IN SIMULATED DISSOLVER SOLUTION

| Solution | Sucrose Addition Grams | Corrosion Rate mil/mo |
|---|---|---|
| Simulated Dissolver Solution | none | 3.4 |
| Simulated Dissolver Solution | 3.5(per day) | 0.2 |
| Solution of 0.01 M $Ru(NO_3)_3$ in 4 M $HNO_3$ | none | 3.7 |
| Solution of 0.01 M $Ru(NO_3)_3$ in 4 M $HNO_3$ | 3.5(per day) | 0.2 |

EXAMPLE 4

Utilizing conditions identical to those set forth in Example 2, 304L stainless steel coupons were exposed to simulated waste solutions in which the molarity of nitric acid varied as set forth below and the temperature was varied as indicated below. Where sucrose was added, it was added at 72 hour intervals in increments of 8 grams/liter of waste solution. The volume of waste solutions for each test was 500 ml. The acidity was held constant by additions of 16 M $HNO_3$. The results are set forth in Table III below.

TABLE III

| Molarity of $HNO_3$ | Temp., ° C. | Sucrose Added, grams | Corrosion rate, mil/mo* |
|---|---|---|---|
| 4 | Boiling | None | 8.3 |
| 4 | Boiling | 4 | 0.8 |
| 4 | 95–100 | None | 2.3 |
| 4 | 95–100 | 4 | 0.2 |
| 6 | 95–100 | None | 4.3 |
| 6 | Boiling | 4 | 1.8 |
| 8 | Boiling | 4 | 10.4 |
| 8 | 95–100 | 4 | 0.3 |

*The rates where no sucrose was added are average values obtained during six 1-week exposures, whereas six 72-hour exposures were used in tests where sucrose was added.

What is claimed is:

1. A method of inhibiting the corrosive effect of a nitric acid solution towards stainless steel, said solution containing dissolved ruthenium values present in an oxidation state of at least +4 which comprises treating said solution with a reducing agent consisting essentially of nitrogen dioxide in an amount sufficient to reduce substantially all of the dissolved ruthenium values having an oxidation state of at least +4 to an oxidation state of less than +4.

2. The method of claim 1 wherein the reducing agent is nitrogen dioxide.

3. The method of claim 1 wherein the nitric acid solution is present at a temperature in the range of about 60° C. to about the boiling point of the solution.

4. The method of claim 3 wherein the nitric acid solution is present at a temperature in the range of 90° to 100° C.

5. The method of claim 1 wherein the concentration of the dissolved ruthenium values having an oxidation state of at least +4 is at least 0.001 molar.

6. The method of claim 1 wherein the concentration of nitric acid in said nitric acid solution is in the range of about 2 to about 10 molar.

7. The method of claim 6 wherein the concentration of nitric acid in said nitric acid solution is in the range of 3 to 6 molar.

8. The method of claim 1 in which the reducing agent is generated in situ in said nitric acid solution by adding to the nitric acid solution a sugar consisting essentially of mono- or di- saccharide or a mixture containing such mono- or di- saccharide in an amount sufficient to reduce substantially all of the dissolved ruthenium values having an oxidation state of at least +4 to an oxidation state of less than +4.

9. The method of claim 8 wherein the sugar is selected from the group consisting of fructose, glucose, xylose, arabinose, galactose, sucrose, maltose, lactose, cellobiose, molasses and corn syrup.

10. The method of claim 9 in which the sugar is sucrose.

11. The method of claim 10 in which at least about 0.05 mole of sucrose is added to said solution per mole of dissolved ruthenium values present at an oxidation state of at least +4.

12. The method of claim 11 in which at least 0.1 mole of sucrose is added to said solution per mole of dissolved ruthenium values present at an oxidation state of at least +4.

13. The method of claim 1 in which the stainless steel is selected from the group consisting of austenitic, ferritic and martensitic stainless steels.

14. The method of claim 13 in which the stainless steel is an austenitic stainless steel.

15. A method of inhibiting the corrosive effect of a nitric acid solution toward austenitic stainless steel, said solution being present at a temperature in the range of about 60° C. to the boiling point of the solution, a nitric acid concentration of 3 to 6 molar and a concentration of dissolved ruthenium values present in an oxidation state of at least +4 which comprises adding at least 0.1 mole of sucrose per mole of dissolved ruthenium values having an oxidation state of at least +4 to thereby substantially reduce all of said ruthenium values to an oxidation state of less than +4 with less than 0.005 mole of dissolved ruthenium values remaining in said solution in an oxidation state of at least +4.

* * * * *